United States Patent [19]

Cole

[11] Patent Number: 4,782,434

[45] Date of Patent: Nov. 1, 1988

[54] LIGHTING UNITS

[76] Inventor: Robert L. Cole, 32 Holdbrook, Hitchin, Hertfordshire, England, SG4 9QW

[21] Appl. No.: 119,046

[22] Filed: Nov. 10, 1987

[30] Foreign Application Priority Data

Nov. 22, 1986 [GB] United Kingdom ..... 8627987

[51] Int. Cl.[4] ..... F21P 3/00

[52] U.S. Cl. ..... 362/252; 362/121; 362/807

[58] Field of Search ..... 362/121, 226, 252, 807, 362/811

[56] References Cited

U.S. PATENT DOCUMENTS

| | | | |
|---|---|---|---|
| 3,400,263 | 9/1968 | Yakim | 362/121 |
| 3,805,049 | 4/1974 | Frank et al. | 362/811 X |
| 4,339,787 | 7/1982 | Burnbaum | 362/121 |

FOREIGN PATENT DOCUMENTS 2060852 5/1981 United Kingdom .

*Primary Examiner*—Stephen F. Husar

*Attorney, Agent, or Firm*—Marjama & Pincelli

[57] ABSTRACT

A lighting unit provides a twindling effect by having a plurality of individual lamps within one unit and having electrical driving means to illuminate the lamps at different time intervals, preferably with a degree of randomness.

5 Claims, 1 Drawing Sheet

LIGHTING UNITS

FIELD OF THE INVENTION

This invention relates generally to lighting units, and is particularly concerned with a flashing light unit which is particularly suitable for use as a Christmas tree decoration.

Although the present invention in its broader aspects has application to decorative lighting units for various purposes, it is particularly well suited for use on Christmas trees.

It is an object of the present invention to provide a lighting unit which, in one unit, contains a plurality of individual lamps which are arranged to flash in a random manner.

It is another object of the present invention to provided a lighting unit which, in the one unit, contains a plurality of lamps, and which incorporates an electronic circuit which is designed to produce a twinkling effect from the lamps.

It is yet another object of the invention to provide a lighting unit, particularly for Christmas trees, which can be connected directly to one lamp socket of a conventional set of lights which has a plurality of sockets each containing an individual bulb. By powering the lighting unit of the present invention directly from one lamp socket of a set of sockets one eliminates the need for a separate power supply unit, thus reducing production costs considerably and simplifying the fitting of the light unit for the user.

SUMMARY OF THE INVENTION

In accordance with the present invention there is provided a lighting unit comprising a plurality of individual lamps within one lighting unit, with the unit comprising electrical driving means arranged to produce illumination of the respective lamps at different time intervals, and further comprising connector means by which the unit can be fitted, as a unit, to an associated plug.

In one preferred embodiment of the invention the lighting unit is formed as a star which incorporates for example six individual lamps which are arranged to be illuminated at different time intervals, thus creating a flashing, twinkling effect.

Preferably, the triggering of the illumination of the respective lamps is arranged to occur with a degree of randomness.

Desirably, the randomness of the illumination of the individual lamps is achieved by incorporating electrolytic capacitors into the driving circuit. The characteristics of such capacitors will change slightly with time and this will of itself create a degree of randomness of illumination.

BRIEF DESCRIPTION OF THE DRAWINGS

In order that the invention may be more fully understood, one presently preferred embodiment of lighting unit in accordacne with the invention will now be described by way of example and with reference to the accompanying drawing, in which.

DESCRIPTION OF THE PREFERRED EMBODIMENT

Figure 1:
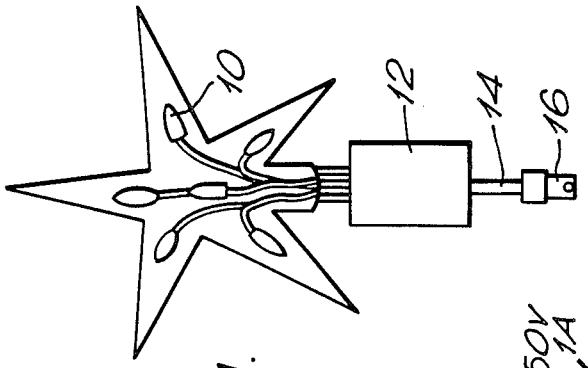
FIG. 1 is a schematic illustration of the lighting unit.

Referring first to FIG. 1, this shows the lighting unit of the present invention, formed in the shape of a star made of transparent plastics material and provided with a light-reflecting backing in order to enhance the effect created by the individual lamps 10 which are positioned within the star. In the present embodiment of the invention there are six individual lamps 10 within the unit. The individual lamps 10 are connected to an electronic circuit indicated generally at 12 which is mounted on a driver board and which drives the filament lamps. The driver board has wire leads 14 connecting it to a plug 16. The plug 16 may be a pushfit or screw-in type connector, and is preferably appropriate to be fitted into a plug socket of a conventional string of Christmas tree lights.

Figure 2:
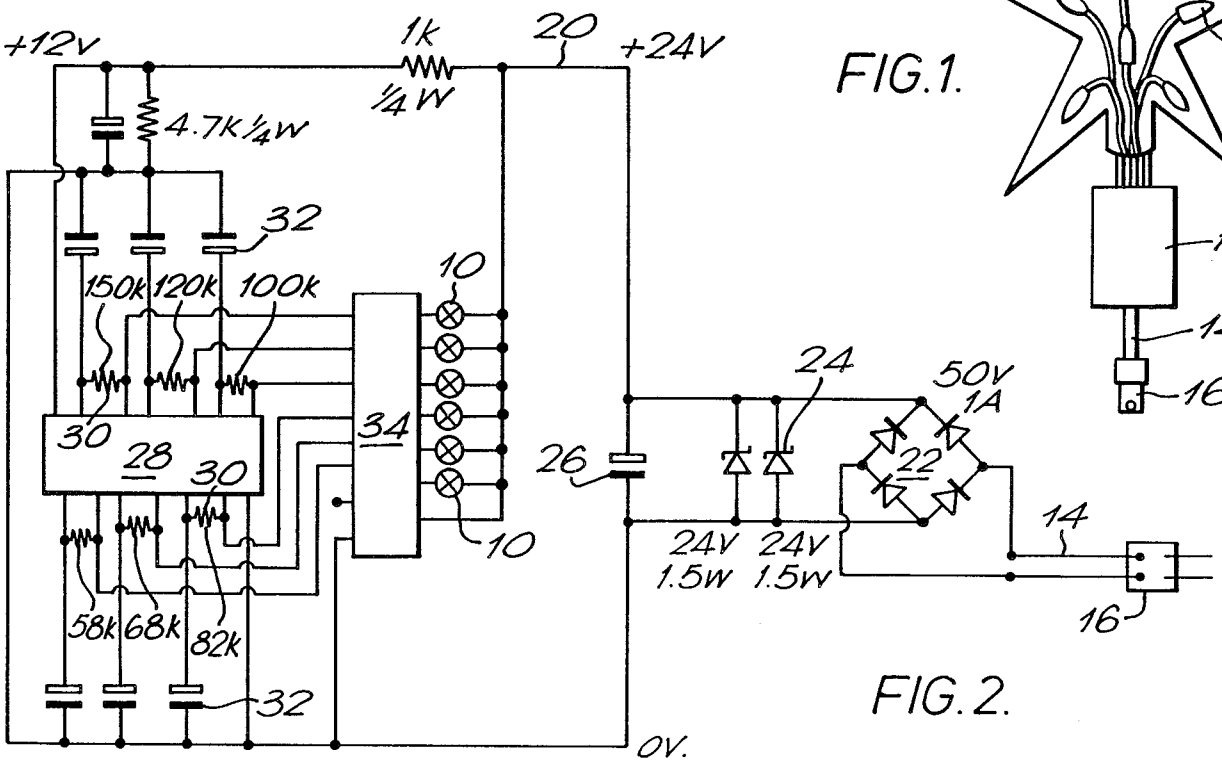
FIG. 2 is a schematic circuit diagram of a circuit for driving the lighting unit.

Referring now to FIG. 2, this circuit diagram indicates how the individual lamps 10 are powered. The lamps 10 are here shown as 24 V. 20 mA lamps connected to a +24 volt rail 20. The power for the lamp circuit is derived via the plug 16 through a bridge rectifier 22 for the ac input, two zener diodes 24 and a smoothing capacitor 26. This provides a smooth 24 V., 100 mA dc voltage. By this arrangement one is effectively "borrowing" only 24 volts from the power supply, so that when the lighting unit is connected into a conventional string of Christmass tree lights one does not dull the other lamps in the set by fitting the lighting unit of the present invention.

The driver circuit includes an integrated circuit 28 which essentially comprises 6 free-running oscillators. Associated with each of these oscillators is a timing circuit comprising a resistance and a capacitance. The individual resistances are indicated at 30 and, as will be seen from FIG. 2, have different resistance values, here shown as from 56 k to 150 k. The capacitances are provided by respective electrolytic capacitors 32 which are all 10 $\mu$F, 16 V. electrolytic capacitors. Thus, each RC circuit 30, 32 provides a different time delay for the output signal to a higher power driver 34 to which the individual lamps 10 are connected. The values of the individual resistors 30 are chosen so that the output signals to the driver circuit 34, and thus to the lamps, occur at different time intervals, so that the lamps 10 will be illuminated in turn. The period for which each lamp 10 is illuminated is preferably short, in order to produce a "twinkling" effect, although the period of illumination can be arranged to vary from lamp to lamp by modification of the RC circuits. In addition to this, because the electrolytic capacitors will tend to drift slightly with time and with changes in temperature, this will introduce a degree of randomness into the RC timing circuits so that the time intervals set by the values of the resistors 30 will change with time and the triggering of the lamps 10 will therefore occur in a random manner. With this circuit one can have 1, 2, 3, 4, 5 or even 6 of the lamps illuminated at any one time. One can nevertheless achieve a flashing effect where the flashes occur at different and random intervals.

It should be understood that the present invention is not limited to the use of six lamps within one lighting unit but could be based upon a greater or lesser number of lamps. Furthermore, although the flashing lighting unit of the present invention is particularly well suited for producing a decorative effect on a Christmas tree, it could be used for other lighting applications, for example in shop-window displays, advertising displays, etc.

While the invention has been particularly shown and described with reference to a preferred embodiment thereof, it will be understood by those skilled in the art that changes in form and details may be made therein without departing from the spirit and scope of the invention.

What is claimed:

1. A lighting unit comprising a plurality of individual lamps within one lighting unit, triggering means to cause each lamp to be illuminated repetitively at time intervals determined for each said lamp and initiated for each lamp independently of the other lamps, the time intervals not being equal for said lamps and each of said time intervals itself being variable with time in a random manner, and with the periods of illumination of the lamps being short in order to produce a flashing effect, and connector means by which the unit can be fitted, as a unit, to an associated plug.

2. A lighting unit as claimed in claim 1, in which the triggering means includes an electrolytic capacitor associated with each said lamp.

3. A lighting unit as claimed in claim 1, in which said triggering means comprises a different RC timedelay circuit for each said lamp.

4. A lighting unit as claimed in claim 1, in which the connector means includes a rectifier for connection to the associated plug, diode means at the power output side of the rectifier, and smoothing means.

5. A lighting unit as claimed in claim 1, formed as a star of plastics material.

* * * * *